US006505021B2

(12) United States Patent
Shibuya et al.

(10) Patent No.: US 6,505,021 B2
(45) Date of Patent: Jan. 7, 2003

(54) IMAGE FORMING APPARATUS HAVING A MEMBER FOR BARRING AN ELECTRIFICATION PARTICLE FORM LEAKING

(75) Inventors: Kenichi Shibuya, Shizuoka-ken (JP); Atsushi Takeda, Mishima (JP); Fumiteru Gomi, Shizuoka-ken (JP); Kouichi Hashimoto, Numazu (JP); Yoshiyuki Komiya, Mishima (JP); Shuichi Kadota, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/816,361

(22) Filed: Mar. 26, 2001

(65) Prior Publication Data

US 2001/0041082 A1 Nov. 15, 2001

(30) Foreign Application Priority Data

Mar. 27, 2000 (JP) ..... 2000-086398
May 31, 2000 (JP) ..... 2000-162068

(51) Int. Cl.[7] ..... G03G 15/30; G03G 15/02
(52) U.S. Cl. ..... 399/149; 399/174
(58) Field of Search ..... 399/115, 149, 399/150, 168, 174, 175, 176, 98

(56) References Cited

U.S. PATENT DOCUMENTS 4,975,746 A 12/1990 Miyauchi et al. ..... 355/245
5,196,892 A * 3/1993 Mitsuaki ..... 399/150
5,333,041 A * 7/1994 Ito et al. ..... 399/149
5,367,365 A * 11/1994 Haneda et al. ..... 399/174
5,457,522 A * 10/1995 Haneda et al. ..... 399/176
5,592,264 A * 1/1997 Shigeta et al. ..... 399/175
5,740,500 A 4/1998 Hashimoto ..... 399/114
5,923,924 A 7/1999 Hashimoto ..... 399/111
6,002,900 A * 12/1999 Ishiyama ..... 399/149
6,006,055 A * 12/1999 Furuya ..... 399/149
6,016,408 A 1/2000 Hashimoto et al. ..... 399/27
6,044,235 A 3/2000 Hashimoto et al. ..... 399/99
6,101,352 A 8/2000 Hashimoto et al. ..... 399/119
6,151,459 A 11/2000 Hashimoto et al. ..... 399/27
6,219,509 B1 * 4/2001 Komiya et al. ..... 399/168
6,341,207 B1 * 1/2002 Sasaki et al. ..... 399/149

FOREIGN PATENT DOCUMENTS

JP 59-133569 7/1984

* cited by examiner

*Primary Examiner*—Sandra Brase
(74) *Attorney, Agent, or Firm*—Fitzpatrick, Cella, Harper & Scinto

(57) ABSTRACT

An image forming apparatus includes an image bearing member which is movable; an electrifying device which makes contact with the image bearing member and electrifies the image bearing member; a developing device for developing a latent image on the image bearing member by toner; and an abutting member which is provided on a downstream side in a moving direction of the image bearing member with respect to the electrifying device and the contacting portion of the image bearing member and abuts against the image bearing member. The image bearing member, electrified by the electrifying device, is exposed to have the latent image formed thereon, a toner image formed on the image bearing member by the developing device is transferred to a recording material, and the developing device recovers residual toner on the image bearing member after transfer.

11 Claims, 10 Drawing Sheets

IMAGE FORMING APPARATUS HAVING A MEMBER FOR BARRING AN ELECTRIFICATION PARTICLE FORM LEAKING

BACKGROUND OF THE INVENTION

1. Field of the Invention

The present invention relates to an image forming apparatus such as a copier and a printer and a process cartridge detachably attachable thereto, and more particularly, to an apparatus for recovering residual toner on an image bearing member by developing means after transfer.

2. Related Background Art

Recently, miniaturization of an image forming apparatus, such as an electrophotographic copier and a printer, has been proceeding. There have been limits to the miniaturization effected merely by miniaturizing each means in a process of forming an image such as electrifying, exposing, developing, transferring, fixing and cleaning.

In an image forming apparatus of the transferring type, some transfer residual toner on a photosensitive member (hereinafter referred to a photosensitive drum) as an image bearing member after transfer is collected by a cleaner as waste toner, which is preferably not produced due to its environmental impact.

This has caused the development of an image forming apparatus of a cleaner-less system, where a cleaner is removed to carry out cleaning simultaneous with developing of the transfer residual toner by a developing apparatus (developing device). The cleaning simultaneous with developing is a method of recovering some transfer residual toner on the photosensitive drum after the transfer by a fog clearing bias (a potential difference of the fog clearing bias "V back," which is the potential difference between a direct voltage applied on developing means and a surface potential of the photosensitive drum) at the time of developing in and after a next process.

According to this method, the transfer residual toner is recovered by the developing means to be used in and after the next process, which produces no waste toner and reduces trouble in maintenance. Such a cleaner-less system has a great space advantage to permit the considerable miniaturization of the image forming apparatus. Further, an electrifying apparatus (electrifying device) of the contact-electrifying type permits recovering of the transfer residual toner by an electrifying member, which makes contact with the photosensitive drum and discharging the same again onto the photosensitive drum to be recovered by the developing means.

Moreover, the contact electrifying apparatus, namely an apparatus of a type that effects electrification by causing a voltage-applied electrifying member to abut against the photosensitive drum, has been in practical use as the electrifying means of the photosensitive drum because of its advantage of low power or the like.

As such a contact electrifying apparatus, a magnetic brush electrifying apparatus has been preferably used in terms of stability of an electrifying contact. In the magnetic brush electrifying apparatus, the electrification is started by magnetically attracting conductive magnetic particles, functioning as a magnetic brush, directly on a magnet or a sleeve containing the magnet, stopping or rotating the magnetic brush to be contacted with the photosensitive drum, and applying the voltage thereon.

Conductive fibers in the form of a brush (a fur brush) and a conductive rubber roller, which is a rolled conductive rubber have been preferably used as a contact electrifying member.

The electrifying apparatus of the magnetic brush type and, as the photosensitive drum, a normal organic photosensitive drum having a surface on which the conductive fine particles are dispersed or an amorphous silicon photosensitive drum, are used to make it possible to obtain, on the surface of the photosensitive drum, an electrifying potential substantially the same as a direct component of the bias applied on the magnetic brush as the contact electrifying member. Such an electrifying method is called injecting electrification. This injecting electrification utilizes, in the electrification to the photosensitive drum, no electric discharging phenomenon as in the case of using a corona electrifying device, these by permitting the electrification without ozone and by consuming a small amount of power, and attention has been paid thereto.

In the image forming apparatus using such an injection electrifying method, use of a spherical carrier granulated by polymerizing as the conductive magnetic particle (hereinafter referred to as an injection carrier) narrows an area in contact with the photosensitive drum and prevents reaching a desired potential to cause a defective image, such as fog or a ghost, when passing-sheet enduring is continued.

This brings the use of a carrier granulated by grinding (hereinafter referred to a ground carrier) instead of the spherical injection carrier. The ground carrier produces a finely powdered carrier, which enlarges the area in contact with the photosensitive drum and thereby increases an electrifying property of the photosensitive drum. Further, the ground carrier is easy to convey and produces large friction against the photosensitive drum, which facilitates recovering the transfer residual toner and increases the cleaning property.

When such injection electrification is used as the electrifying method, the injection carrier is preferably of grounded shape in order to prevent degradation of the image resulting from the poor electrification.

In the injection electrifying method, the photosensitive drum passes an electrifying portion (electrifying area or electrifying nip) which is a contacting portion with the magnetic brush as the contact electrifying member. If the electrification is carried out merely by applying a DC (direct current) bias, the potential difference between a carrying member for the magnetic brush (hereinafter referred to as an injection sleeve) and the photosensitive drum is wide when the photosensitive drum starts contact with the magnetic brush at the electrifying portion so that the resistance of the injection carrier is low to facilitate the flow of the current.

Just before the photosensitive drum is separated from the electrifying portion, however, the potential is on the surface of the photosensitive drum to decrease the potential difference between the injection sleeve and the photosensitive drum and to thereby increase the resistance of the injection carrier. It is known that this causes difficulty in the flow of the current and reduces the electrifying property of the photosensitive drum (FIG. 5).

For this reason, in the injection electrifying method, an AC (alternate bias) is often applied at the same time as applying the DC (direct bias applying) as the electrifying bias. Applying the AC decreases the resistance of the injection carrier to facilitate the flow of the current and to increase the electrifying property to the photosensitive drum, which permits the electrification to a desired potential.

However, the electrification by simultaneously applying the AC causes a micro potential difference between the photosensitive drum and the injection sleeve corresponding to a waveform of the AC. An example of this is shown in FIG. 6. For example, when the electrification is carried out at −500 V by applying the DC and simultaneously by applying the AC at 700 Vpp, there exist locally a potential differences of −150 V at the injection sleeve and −850V at the photosensitive drum. The potentials of the injection sleeve and the photosensitive drum are the same during the time when the photosensitive drum passes the electrifying portion, which is the contacting portion with the magnetic brush, and just after the photosensitive drum has passed the electrifying portion, phases of the potentials are shifted between the injection sleeve and the photosensitive drum. The shift of the phase occurs such that the injection sleeve at −150 V and the photosensitive drum at −850 V causes a potential difference at 700 V between the injection sleeve and the photosensitive drum. At this time, between the injection sleeve and the photosensitive drum, a voltage drop between the injection carrier and the photosensitive drum is the largest, so that the injection carrier is attracted to the photosensitive drum. This phenomenon is called "carrier adhesion".

When the injection electrification is used as the electrifying method, simultaneously applying the AC is preferable and some occurrence of such carrier adhesion cannot be avoided during the injection electrification.

When the injection carrier, after carrier adhesion, reaches a transferring portion, the injection carrier enters a nip between a transferring member and the photosensitive drum, which results in damaging the photosensitive drum.

The potential has difficulty reaching a once damaged portion of the photosensitive drum so that the potential difference between the injection sleeve and the photosensitive drum is increased to acceleratedly increase the carrier adhesion. Repeating a passing-sheet test then further deepens the damage of the photosensitive drum and the potential does not reach the damaged portion so that the phenomenon of streak-like developing (hereinafter referred to "streak-like fog") occurs.

When the injection carrier is changed in its shape from spherical to ground in order to increase the electrifying property, the particle of the ground carrier has a large number of edges in contact with the photosensitive drum at points, so that pressures thereon are also increased. Accordingly, the use of the ground carrier especially often damages the photosensitive drum to easily cause a defective image by the damage before twenty thousand sheets are passed in the passing-sheet test.

In the light of the above condition, Japanese Patent Application Laid-Open No. 59-133569 discloses a mechanism of trapping magnetic fine particles that abuts a blade against the photosensitive drum on an downstream side in a rotational direction of the photosensitive drum with respect to a magnetic brush electrifying member to trap and recover the magnetic fine particles separated from a magnetic brush and moved to the photosensitive drum. In this case, when the ground carrier enters a nip between the blade and the photosensitive drum, the carrier is likely to damage the surface of the photosensitive drum, and its influence is much stronger especially in the photosensitive drum, which surface is not very hard. At this time, the use of such a blade damages the photosensitive drum and causes the production of a defective image when the passing-sheet test of ten thousand sheets is performed.

In the cleaner-less system that recovers the transfer residual toner by the magnetic brush electrifying member and discharges the same again onto the photosensitive drum to be recovered again by the developing apparatus, the toner discharged from the magnetic brush is also damaged by the above described blade to cause remarkable contamination from the toner in the electrifying apparatus. This prevents the electrification to the desired potential, resulting in a defective image, such as fog or a ghost, due to the poor electrification when passing-sheet test of ten thousand sheets is performed.

In the above-described electrifying apparatus, the transfer residual toner is once recovered in the contact electrifying member and then discharged onto the image bearing member by a potential operation to be recovered by the developing apparatus. However, all the transfer residual toner having reached the above-described electrifying apparatus is not ideally discharged, with the normal charge maintained, onto the image bearing member and passed on the image bearing member to be recovered by the developing apparatus. The remaining toner is finally accumulated in the electrifying apparatus or spattered from the contact electrifying member or the image bearing member to contaminate the inside of a body of the image forming apparatus. Especially in a system where exposing means, such as an LED, is arranged near the electrifying apparatus, the spattered toner attached to a surface of the LED to thereby shut off exposure, will cause an undesirable lack of an image.

Further, the toner, to which the normal charge is not applied, among the toner discharged onto the image bearing member, is neither recovered in the developing apparatus in a developing area nor transferred to move around on the image bearing member, thereby causing disadvantages such as spattering or shutting off the exposure when its concentration is increased.

SUMMARY OF THE INVENTION

An object of the present invention is to provide an image forming apparatus and a process cartridge detachably attachable thereto that prevents damage to an image bearing member by a conductive particle and contamination from toner by electrifying means.

Another object of the present invention is to provide an image forming apparatus and a process cartridge detachably attachable thereto which prevents spattering of the toner from the electrifying means.

Still another object of the present invention is to provide an image forming apparatus comprising: an image bearing member which is movable; electrifying means which makes contact with the image bearing member and electrifies the image bearing member; developing means for developing a latent image on the image bearing member by toner; and an abutting member which is provided on a downstream side in a moving direction of the image bearing member with respect to the electrifying means and a contacting portion of the image bearing member and abuts against the image bearing member, the image bearing member electrified by the electrifying means being exposed to have the latent image formed thereon, a toner image formed on the image bearing member by the developing means being transferred to a recording material, and the developing means recovering residual toner on the image bearing member after transfer.

A further object of the present invention is to provide an image forming apparatus and a process cartridge detachably attachable thereto comprising: an image bearing member which is movable; electrifying means which has a carrier for carrying a conductive particle and interposes the conductive particle between the carrier and the image bearing member to electrify the image bearing member; developing means for developing a latent image on the image bearing member by toner; and an abutting member which is provided on a downstream side in a moving direction of the image bearing member with respect to the electrifying means and a contacting portion of the image bearing member and abuts against the image bearing member, the conductive particle of the electrifying means making contact with the image bearing member, the image bearing member electrified by the electrifying means being exposed to have the latent image formed thereon, a toner image formed on the image bearing member by the developing means being transferred to a recording material, the developing means recovering residual toner on the image bearing member after transfer, and the pressure of the abutting member against the image bearing member being 0.3 to 3 kPa.

A still further object of the present invention is to provide an image forming apparatus and a process cartridge detachably attachable thereto comprising: an image bearing member which is movable; electrifying means which makes contact with the image bearing member and electrifies the image bearing member; developing means for developing a latent image on the image bearing member by toner; and an abutting member which is provided on a downstream side in a moving direction of the image bearing member with respect to the electrifying means and a contacting portion of the image bearing member and abuts against the image bearing member, the image bearing member electrified by the electrifying means being exposed to have the latent image formed thereon, a toner image formed on the image bearing member by the developing means being transferred to a recording material, the developing means recovering residual toner on the image bearing member after transfer, and the abutting member being provided on the electrifying means.

A yet further object of the present invention is to provide an image forming apparatus and a process cartridge detachably attachable thereto comprising: an image bearing member which is movable; electrifying means which has a carrier for carrying a conductive particle and interposes the conductive particle between the carrier and the image bearing member to electrify the image bearing member; and developing means for developing a latent image on the image bearing member by toner, the image bearing member electrified by the electrifying means being exposed to have the latent image formed thereon, a toner image formed on the image bearing member by the developing means being transferred to a recording material, the developing means recovering residual toner on the image bearing member after transfer, and the electrifying means having a regulating member for regulating the amount of the conductive particle on the carrier and a shutting-off member for shutting off spattered toner provided on a downstream side in a moving direction of the carrier with respect to the regulating member.

DETAILED DESCRIPTION OF THE PREFERRED EMBODIMENTS

Hereinafter, the embodiments of the present invention will be described with reference to the drawings.

(1) Schematic Configuration of the Image Forming Apparatus Example

Figure 1:
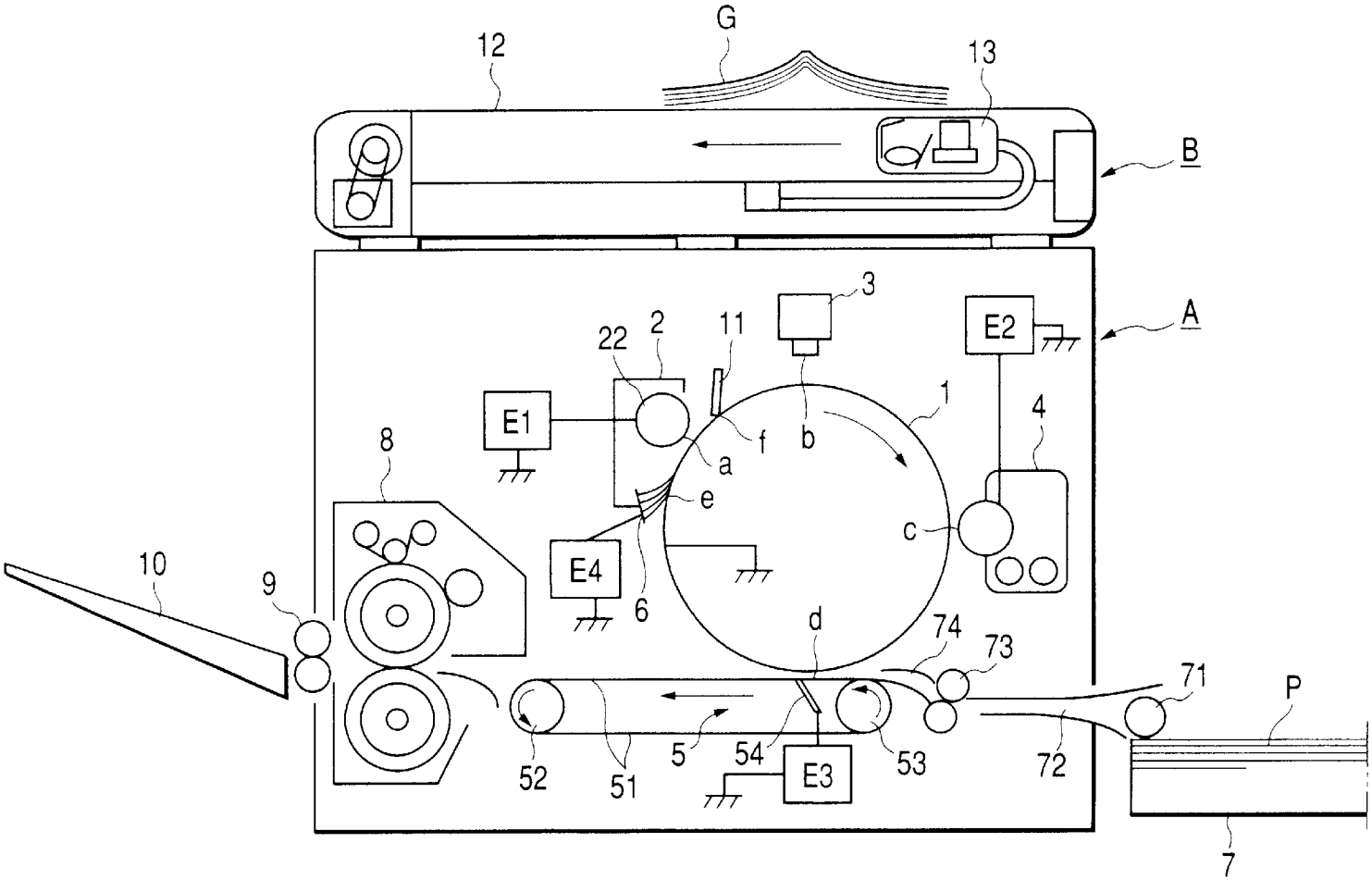
FIG. 1 is a view showing an image forming apparatus according to an embodiment of the present invention.

FIG. 1 is a schematic configuration view of the image forming apparatus example according to the present invention. The image forming apparatus of the present example is a printer of an electro-photographic process, a magnetic brush electrification system, an LED exposure system, a reverse developing system and a cleaner-less type. Reference symbol A denotes a printer main body and reference symbol B denotes a image reading apparatus (image scanner) mounted on this printer.

a) Image Reading Apparatus B

In the image reading apparatus B, reference numeral 12 denotes an original support glass (platen glass) fixedly disposed on the top surface of the apparatus, and on the top surface of this original support glass, an original G is placed with its surface to be copied put downward and is covered with an original pressure plate (note shown) on it for setting.

Reference numeral 13 denotes an image reading unit, where an original illumination lamp (original lighting lamp), a short focus lens array, a CCD sensor and the like are disposed. This image reading unit 13 is, when a copy button (not shown) is pushed, driven onward along the under surface of the glass from the right comer side of a home position as shown by a solid line to the left comer side under the original support glass 12 and, upon reaching the last stop, driven back to the initial home position as shown by the solid line.

In the course of the reciprocating movement of the unit 13, the downward image surface of the original G mounted for setting on the original support glass 12 is scanned in order from the right comer side to the left comer side by the original illumination lamp, and the reflected light on the original surface of the illumination scanning light is imaged and incident upon the CCD sensor by the short focus lens array.

The CCD sensor is composed of a light receiving region, a transfer region, and an output portion. In the CCD light receiving portion, light signals are converted to charged signals and, synchronized with clock pulses in the transfer region and are transferred in order to the output portion. In the output portion, the charged signals are converted to voltage signals and amplified, induced to low impedance and outputted. The analog signals obtained in this way are processed by a known image processing operation, converted to digital signals, and transmitted to the printer A.

That is, the image information of the original G is read by the image reading apparatus B as time-series, electrical, digital, picture-element signals (image signals).

b) Printer A

In the printer A, reference numeral 1 denotes an electrophotographic sensitive member (photosensitive drum) of a rotary drum type as a movable image bearing member. The photosensitive drum 1 of the present example is a negative charged OPC sensitive member having a charge injecting layer on its surface. The description of this sensitive member will be described in detail in section (2).

The photosensitive drum 1 is rotationally driven clockwise in the arrow direction at a predetermined circumferential speed with a central support axis as a center and, when copy signals are input, receives a uniform electrifying processing of −700V at an electrified portion (electrified area, electrified nip portion) in the case of the present example by contact electrifying means 2. The contact electrifying means 2 in the present example is a magnetic brush electrifying device (injecting electrifying device). This magnetic brush electrifying device 2 will be described in detail in section (3).

The scanning exposure of the image information is performed in an exposure region b by the LED exposure device 3 as image exposure means against the uniformly electrified surface of the rotary photosensitive drum 1, and on the surface of the rotary photosensitive drum 1, electrostatic latent images corresponding to the image information of the original G read photoelectrically by the image reading apparatus B are formed in order.

The LED exposure device 3 is a light emitting element array which arranges a number of LEDs in the main scanning direction of the photosensitive drum 1, and the emitted light of each LED of the LED exposure device 3 is selectively controlled ON/OFF corresponding to image signals transmitted to the printer region A side from the image reading apparatus B side. Moreover, the sub scanning by the rotation of the photosensitive drum 1 reduces the electric potential of the exposure portion (light portion potential) through the emitted light of the LED in the surface of the rotary photosensitive drum 1, thereby forming electrostatic latent images corresponding to exposure patterns by contrast with the electrical potential (dark portion potential) of non-exposure portions.

The electrostatic latent images formed in the photosensitive drum 1 surface are reverse developed in order as the toner images in a developing region c by the developing apparatus 4. The developing apparatus 4 of the present example is an apparatus of a two component contact developing system. This developing apparatus 4 will be described in detail in section (4).

On the other hand, a transfer material P as a recording medium stored inside a sheet-feeding cassette 7 is drawn out one by one by a sheet-feeding roller 71 and fed inside the printer main body A through a sheet pass 72 and fed to a transfer portion (transfer nip) d, which is a contact region between the photosensitive drum 1 and a belt type transfer device 5 as transfer means by a registration roller 73 through a sheet pass 74 with a predetermined control timing.

On the surface of the transfer material P fed to the transfer region d, a transfer electrified blade 54 disposed inside a transfer belt 51 electrostatically transfers in order toner images of the photosensitive drum 1. This transfer device 5 will be described in detail in section (5).

The transfer material P which received the transfer of the toner images through the transfer region d is separated in order from the surface of the photosensitive drum 1 and carried to a fixing device 8 at the transfer belt extended portion of the transfer device 5 and outputted as an image formed object (copy, print) on a sheet discharging tray 10 outside of the apparatus from a sheet discharging roller 9 upon receipt of a heat fixation of the toner images.

Reference numeral 6 denotes a conductive brush as supplementary electrifying means and is abutted against the photosensitive drum 1 at the upstream side of the rotational direction of the photosensitive drum rather than the electrified portion a at the downstream side of the rotational direction of the photosensitive drum. Reference symbol e denotes a contact region between this conductive brush 6 and the photosensitive drum 1. In the present example, it is attached and disposed on the magnetic brush electrifying device 2.

Reference numeral 11 denotes an injecting carrier shielding member which is an abutting member disposed by contacting with the photosensitive drum 1 at the downstream side of the rotational direction of the photosensitive drum rather than the electrified region a. Reference symbol f is a contact portion (contact nip portion) between this injecting carrier shielding member 11 and the photosensitive drum 1.

The cleaner-less system, the above described conductive brush 6, and the injecting carrier shielding member 11 will be described in detail in section (6).

(2) Photosensitive Drum 1

For the photosensitive drum 1 as the image bearing member, an organic sensitive member and the like can be used. However, when the organic sensitive member preferably having a surface layer of a material with a resistance of $10^9$ to $10^{14}$ Ω·cm or an amorphous silicon sensitive member and the like are used, a charge injecting charge can be realized. This has a strong effect on preventing the generation of ozone and reducing the consumption of electrical power. The electrostatic property can be also enhanced.

Figure 2:
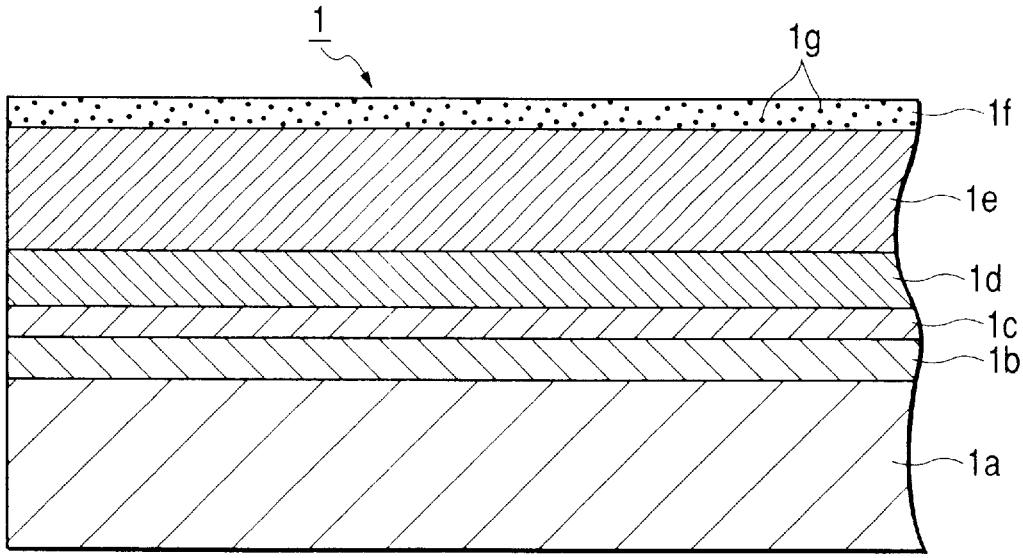
FIG. 2 is a view showing the configuration of a layer of a photosensitive drum.

The photosensitive drum 1 used in the present example is, as shown in a layer structure model view of FIG. 2, the negatively electrified organic sensitive member having a charge injecting layer If disposed on its surface where the following five layers of a first to a fifth layer from 1*b* to 1*f* are disposed on a drum substrate (hereinafter referred to as an aluminum substrate) 1*a* made of aluminum having a diameter of 30 mm.

The first layer 1*b*: an under coating layer, which is an conductive layer with a thickness of 20 μm disposed for equalizing defects and the like of the aluminum substrate 1*a*.

The second layer 1*c*: a positive charge injecting prevention layer, which plays a role of preventing a negative charge where the positive charge injected from the aluminum substrate 1*a* is electrified on the sensitive member surface and is a middle resistance layer having a thickness of 1 μm adjusted in resistance to a degree of $1\times10^6$ Ω·cm by amylene resin and methoxide methylation nylon.

The third layer 1*d*: a charge generating layer, which is a layer having a thickness of approximately 0.3 μm where diazo system pigment is dispersed on resin and generates a pair of positive and negative charges upon receipt of exposure.

The fourth layer 1*e*: a charge carrying layer, where hydrazon is dispersed on polycarbonate resin, and which is a p-type semiconductor. Accordingly, the negative charge electrified on the sensitive member surface cannot move on this layer and can only carry the positive charge generated on the charge generating layer 1*d* on the sensitive member surface.

The fifth layer 1*f*: a charge injecting layer, which is a coating layer of the material where $SnO_2$ ultra micro particles as conductive particles 1*g* are dispersed on the binder of insulated resin, to be concrete, a coating layer of the material where $SnO_2$ particles having a particle size of 0.03 μm where antimony as a light permeable insulated filler is given a doping on the insulated resin and induced to a low resistance (conduction) are dispersed 70 percent by weight against the resin.

The coating liquid prepared in this way was coated with a thickness of approximately 3 μm by a suitable coating method such as a dipping coating method, a spray coating method, a roll coating method, a beam coating method and the like and taken as a charge injecting layer.

(3) Magnetic brush electrifying device 2

Figure 3:
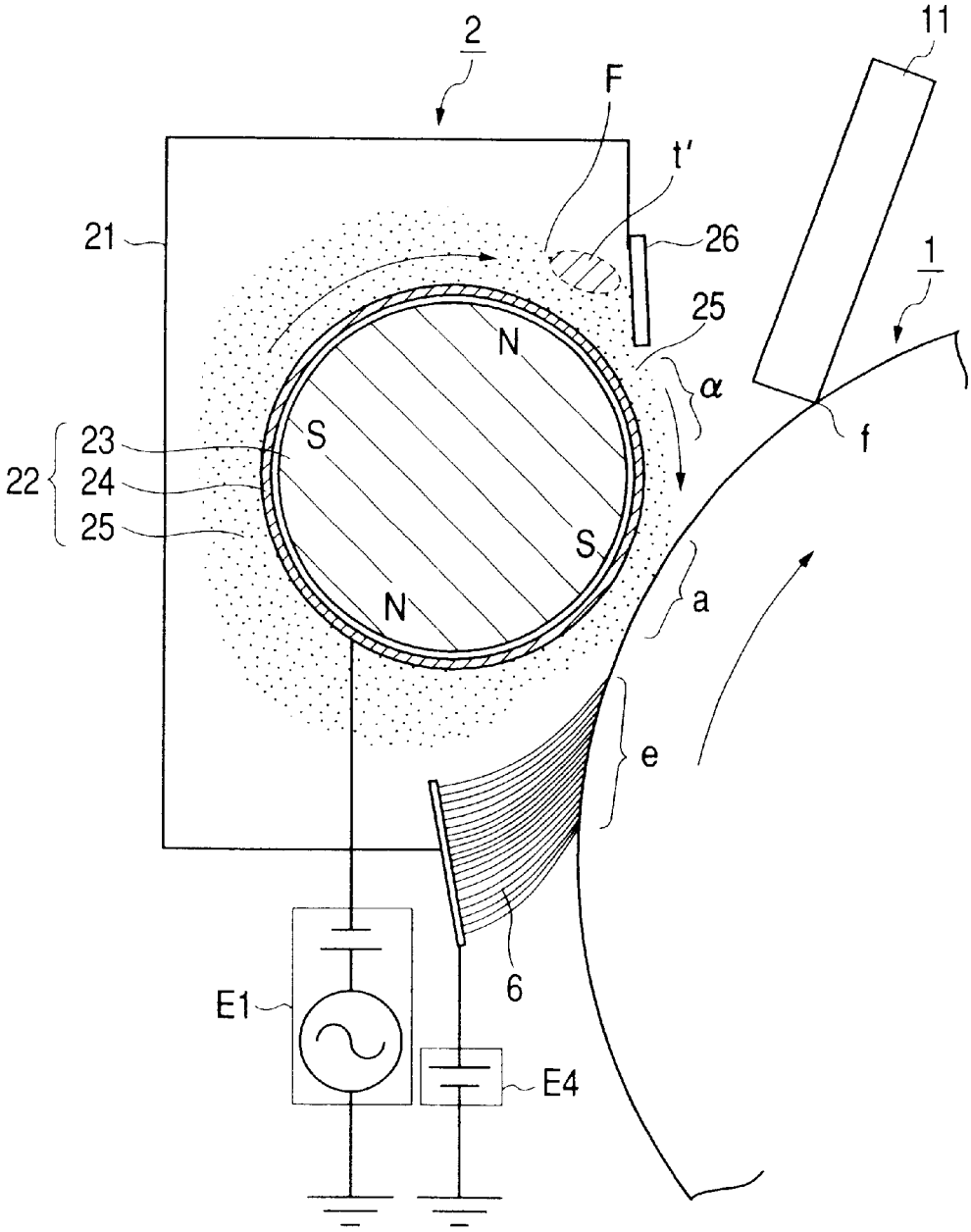
FIG. 3 is a view showing an electrifying apparatus and a periphery thereof.

FIG. 3 is a schematic configuration view of the magnetic brush electrifying device 2 in the present example.

Reference numeral 21 denotes an electrifying device housing and reference numeral 22 denotes a magnetic brush electrified member as a contact electrified member disposed inside this housing. The magnetic brush electrified member 22 of the present example is of a rotary sleeve type and comprises a magnet roll 23 fixedly supported non-rotationally, a non-magnetic injecting sleeve (non-magnetic, conductive/electrifying electrode sleeve) 24 having an outer diameter of 16 mm as a conductive particle bearing member, which is coaxially freely rotationally engaged circumferentially with the outer periphery of this roller, a magnetic brush 25 of an injecting carrier (conductive magnetic particle, magnetic carrier for use of electrification) sucked, held, and formed on the outer peripheral surface of this non-magnetic sleeve by the magnetic force of the magnet roller 23 inside the sleeve and the like. Reference numeral 26 denotes a layer thickness control blade of the magnetic brush 25 disposed fixedly inside the housing 21.

The electrifying device 2 allows the magnetic brush 25 of the magnetic brush electrified member 22 to contact the photosensitive drum 1 surface and to be disposed approximately in parallel with the photosensitive drum 1. In this case, the contact nip width (width of the electrified region a) of the magnetic brush 25 formed against the photosensitive drum 1 was adjusted and disposed so as to have a predetermined width. In the present embodiment, the nip width formed against the photosensitive drum 1 was adjusted so as to be approximately 6 mm.

For the injecting carrier constituting the magnetic brush 25, it is preferable that the average particle size (mean particle diameter) is 10 to 100 μm, the saturated magnetization is 20 to 250 kA/m (emu/$cm^3$), and the resistance is $1\times10^2$ to $1\times10^{10}$ Ω·cm. Considering that insulation defects, such as pin holes, exist in the photosensitive drum 1, the carrier having a resistance of more than $1\times10^6$ Ω·cm is preferably used. To improve the electrification capacity, it is better to use a carrier having a resistance as small as possible. In the present example, magnetic particles having an average particle size of 25 μm, the saturated magnetization of 200 kA/m and the resistance of $5\times10^6$ Ω·cm were used. Note that the injecting carrier is formed by a pulverizing method.

Here, the resistance value of the injecting carrier is measured in such a manner that an injecting carrier of 2 g is put into a metallic cell having a base area of 228 $mm^2$ and, after that, a weight (load) of 6.6 kg is added and a voltage of 100 V is applied.

For the injecting carrier, the resin carrier formed by dispersing magnetite in resin as a magnetic material and also by dispersing carbon black for conduction and resistance adjustment, or the carrier which oxidation-reduction processes the surface of magnetite simple substance such as ferrite and the like and performs a resistance-adjustment on it, or the carrier which coats the surface of magnetite simple substance such as ferrite and the like and performs the resistance-adjustment on it can be used.

The injecting sleeve 24 of the magnetic brush electrified member 22 was rotated at the electrified region a in the arrow direction of the clockwise direction which is the reverse (counter direction) of the rotational direction of the photosensitive drum 1. In the present embodiment, against the rotational speed of 100 mm/sec of the photosensitive drum 1, the sleeve 24 rotates at the speed of 150 mm/sec. Accompanied by the rotation of this injecting sleeve 24, the magnetic brush 25 of the injecting carrier is also rotationally carried in the same direction and receives the layer thickness control at the position of the layer thickness control blade 26. The photosensitive drum 1 surface is slidably uniformly rubbed by the magnetic brush 25 in the electrified region a.

By applying a predetermined electrification bias to the injecting sleeve 24 from a bias power source E1, charge is given on the photosensitive drum 1 from the injecting carrier of the magnetic brush 25, which is electrified with a potential corresponding to an electrification voltage. The faster the rotational speed becomes, the greater the improvement in electrification uniformity.

In the present example, the direct current voltage DC and the alternating voltage (alternative voltage) AC of −700V were superimposed and applied as the electrification bias.

In the case of the present example, as described above, because the photosensitive drum 1 is provided with the charge injecting layer If on its surface, the electrifying processing of the photosensitive drum 1 is performed by charge injecting electrification. That is, from among the DC+AC bias applied to the injecting sleeve 24, an electrification potential approximately identical to the direct current component DC (−700V) can be obtained on the photosensitive drum surface.

(4) Developing Apparatus 4

Figure 4:
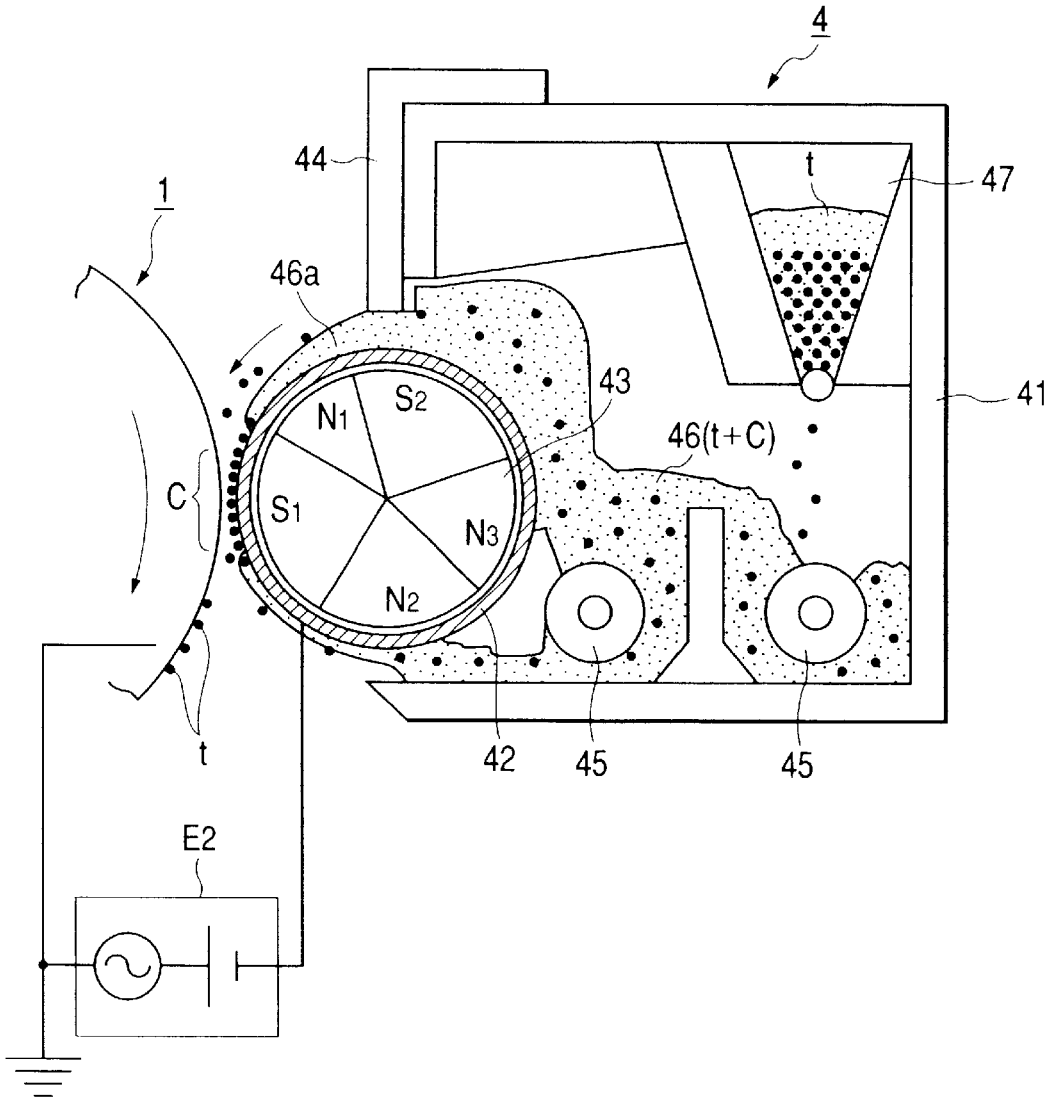
FIG. 4 is a view showing a developing apparatus.
Figure 5:
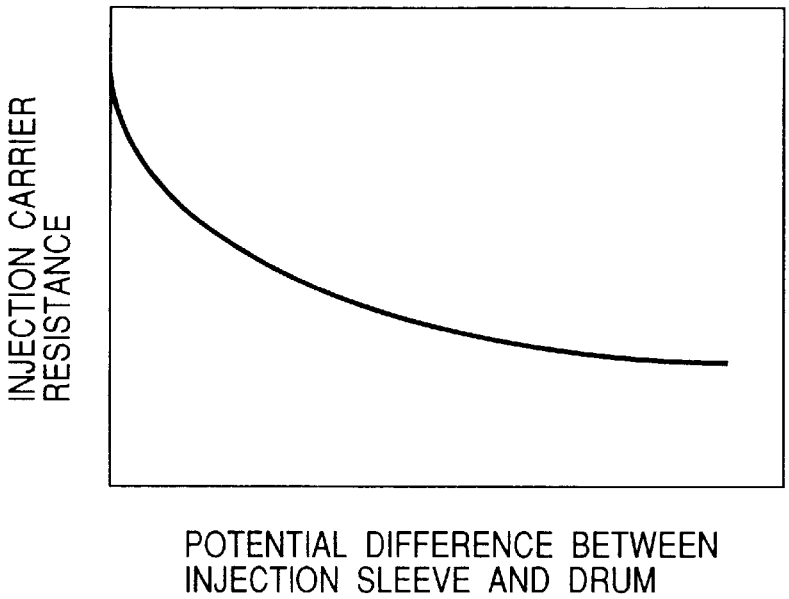
FIG. 5 is a view showing the relationship of a potential difference between an electrifying member and a photosensitive drum and resistance of a conductive particle.
Figure 6:
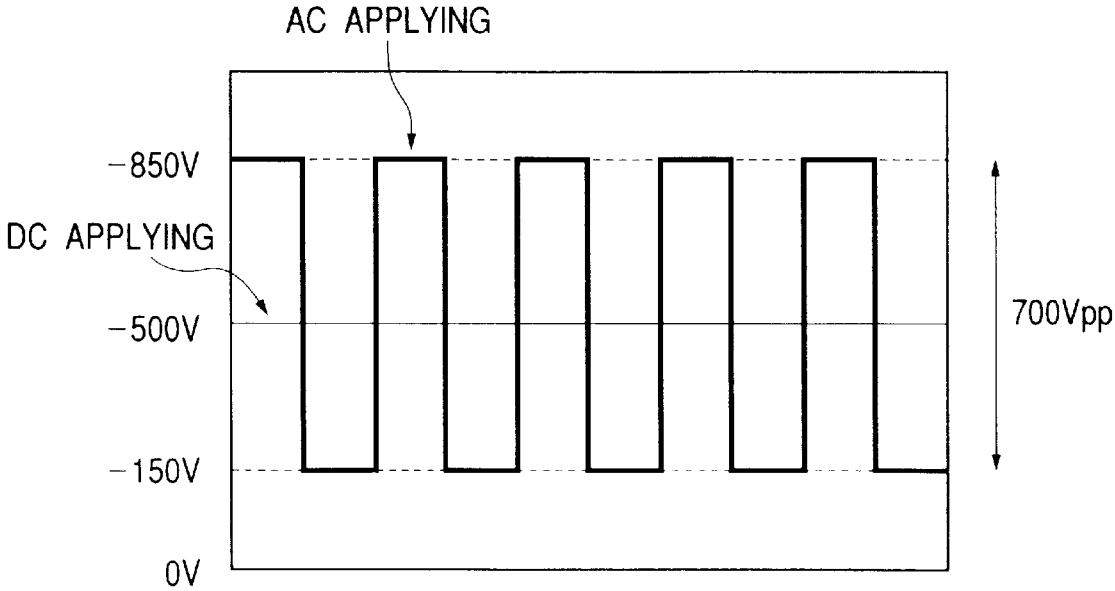
FIG. 6 is a view showing a voltage applied on the electrifying member.

FIG. 4 shows a schematic configuration of the developing apparatus 4 used in the present embodiment. The developing apparatus 4 of the present example uses a mixture of non-magnetic negative toner particles and magnetic carrier particles as a developer. It is an apparatus of a two component magnetic brush contact developing system where the developer is held on a developer bearing member as a magnetic brush layer by magnetic force and carried to a developing portion so as to contact the photosensitive drum 1 surface, thereby developing latent images reversed as toner images.

Reference numeral 41 denotes a developer container, reference numeral 42 a developer sleeve as the developer bearing member, reference numeral 43 a magnet roller as magnetic field generating means fixedly disposed inside the developer sleeve 42, reference numeral 44 a developer layer thickness control blade for forming a thin layer of the developer on the developer sleeve, reference numeral 45 a developer agitation carrying screw, and reference numeral 46 denotes a two component developer housed inside the developer container 41, which mixes non-magnetic negative toner particles t and magnetic carrier particles C.

The two component developer 46 used in the present embodiment uses titanium oxide having an average particle size (mean particle diameter) of 20 nm and externally added with a weight ratio 1% against the negatively electrified toner (hereinafter referred to as pulverized toner) having an average particle size of 6 μm manufactured by an pulverizing method. For a developing magnetic carrier C, the magnetic carrier having an average particle size of 25 μm with the saturated magnetization of 205 kA/m was used. The toner t and the developing magnetic carrier were mixed with a weight ratio of 6 to 94.

The developer sleeve 42 is disposed in such a manner that its closest distance (clearance) to the photosensitive drum 1 becomes approximately 500 μm at least in the developing time and a developer magnetic brush thin layer 46*a* borne on the outer surface of the developer sleeve 42 is set so as to contact the surface of the photosensitive drum 1. The contact region between the developer magnetic brush layer 46*a* and the photosensitive drum 1 is the developing region c.

The developer sleeve 42 is driven in the arrow direction at a predetermined speed around the outer periphery of the magnet roller 43 fixedly disposed, and a magnetic brush of the developer 46 is formed on the outer surface of the sleeve by the magnetic force of the magnet roller 43 inside the developer container 41. The developer magnetic brush is carried with the rotation of the sleeve 42 and, by receiving a thickness control by a blade 44, is taken out from the developer container as the developer magnetic brush thin layer 46*a* having a predetermined layer thickness and is carried to the developing region c so as to contact the photosensitive drum 1 surface and then is carried back again inside the developer container 41 accompanied by the continuous rotation of the sleeve 42.

That is, first of all, the developer 46 drawn up on a $N_3$ pole of the magnet roller 43 accompanied by the rotation of the developer sleeve 42 is, in the course of being carried from a S2 pole to a N1 pole, controlled by a control blade 44 disposed vertically against the developer sleeve 42 and a thin layer 46*a* of the developer 46 is formed on the developer sleeve 42. When the developer layer 46*a* thinly formed is carried to a developing main pole S1 of the developing portion, ears are formed by the magnetic force. By the developer layer 46*a* formed in the shape of ears, the latent images of the photosensitive drum 1 are developed as toner images and, after that, by the repulsive magnetic field of a $N_2$ pole to $N_3$ pole, the developer on the developer sleeve 42 is returned inside the developer container 41.

Between the developer sleeve 42 and a conductive drum substrate of the photosensitive drum 1, in the present example, an amplitude voltage superimposed with a negative direct current voltage:−500V, an alternating voltage: amplitude Vpp=1500V and frequency Vf=3000 Hz is applied as a developing bias by a development bias applying power source E2.

Generally in the two component developing method, when the alternating voltage is applied, developing efficiency is increased and images are highly refined. On the other hand, there is often a risk of causing fog. For this reason, usually by creating a potential difference between the direct current voltage applied to the developing apparatus 4 and the surface potential of the photosensitive drum 1, the fog is prevented. The potential difference for preventing this fog is referred to as a fog cleaning potential (Vback). By this potential difference, the adhesion of the toner to non-image areas of the photosensitive drum 1 is prevented.

The toner density (mixing ratio with the carrier) of the developer 46 inside the developer container 41 is gradually reduced as the toner portion is consumed for developing electrostatic latent images. When the toner density of the developer 46 inside the developer container 41 is detected by detecting means (not shown) and reduced to a predetermined permissible low degree, the toner t is supplied to the developer 46 inside the developer container from a toner supply portion 47 and the toner supply is controlled in such a manner that the toner density of the developer 46 inside the developer container 41 is always kept within a predetermined permissible range.

(5) Transfer Apparatus 5

The transfer apparatus 5 is, in the present example as described above, a transfer belt type. Reference numeral 51 is an endless type transfer belt and is wound across between a driving roller 52 and a slave roller 53 with a predetermined tensile force and oscillated at approximately the same circumferential speed as the rotational circumferential speed of the photosensitive drum 1 in the forward direction in the rotational direction of the photosensitive drum 1. Reference numeral 54 is a transfer electrified blade disposed inside the transfer belt 51 and forms a transfer region d by pressing the upper moving side belt of the transfer belt 51 against the photosensitive drum 1 and, with the transfer bias applied from the transfer bias applying power source E3, performs the electrification in reverse to the polarity of the toner from the back of the transfer material P. In this way, the toner images on the side of the photosensitive drum 1 are electrostatically transferred in order over the surface of the transfer material P passing through the transfer region d.

In the present example, a belt comprising polyimide resin having a film thickness of 75 μm was used as the belt 51. The material of the belt 51 is not limited to polyimide resin, but polycarbonate resin, polyethylene terephthalic resin, polyvinylidene fluoride resin, polyethylene naphtalate resin, polyether etherketone resin, polyether sulfone resin, plastic such as polyurethane resin, rubber of a fluorine system, and a silicon system can be preferably used. The thickness is also not limited to 75 μm, but a thickness of approximately 25 to 2000 μm, preferably 50 to 150 μm can be suitably used.

Moreover, as the transfer electrified blade 54, a blade having a resistance of $1\times10^5$ to $1\times10^7$ Ω, a plate thickness of 2 mm and a length of 306 mm which is orthogonal to the moving direction of the belt 51 was used. By applying a bias of +15 μA to this transfer electrified blade 54 by a constant current control, the transfer was performed.

(6) Cleaner-less System

1) The transfer residual toner remaining on the photosensitive drum 1 surface after the toner images are transferred against the transfer material P is, by the continuous rotation of the photosensitive drum 1 surface, carried away by the conductive brush 6 as a supplemental electrifying device disposed by contacting the surface of the photosensitive drum 1 between the transfer region d and the electrified region a.

To this conductive brush 6, the bias voltage of a predetermined potential, which has a positive polarity in reverse to the negative electrified polarity of the toner, is applied by the power source E4.

In the transfer residual toner, the toner, which is negatively electrified, which is of a normal electrified polarity, the toner having the electrified polarity turned in reverse due to transfer bias, peel discharge and the like at the time of the transfer and the toner in a state where negative electrification is weakened or electrification is rejected are present as a mixture. This transfer residual toner is agitated at the contact portion e between the conductive brush 6 and the photosensitive drum 1. The toner of weak electrification from whichever of the toner negatively electrified as a normal charged polarity, the toner in a state where negative electrification is weakened or electrification is rejected and the toner positively electrified in reverse is actively adhered and mixed with the conductive brush 6 by an electrical suction force attributable to the positively applied bias, and the toner positively electrified in reverse is delivered from the conductive brush 6 to the photosensitive drum 1 surface by an electrical repulsive force to the positive applied bias against the conductive brush 6 and adhered there again.

Accordingly, the transfer residual toner is substantially lined up in the positive polarity where the electrified polarity is in reverse to the normal negative electrified polarity and carried to the electrified region a by the continuous rotation of the photosensitive drum 1.

2) The transfer residual toner on the photosensitive drum 1 which was carried to the electrified region a is entrapped by the magnetic brush 25 of the magnetic brush electrified member 22 and simultaneously electrified and recovered tentatively. In this case, the transfer residual toner carried to the electrified region a is, as described above, substantially lined up positively in the electrified polarity and therefore effectively tentatively recovered from the photosensitive drum 1 surface in the electrified region a by an electrical attractive force against the magnetic brush electrified member 22 applied with negative electrified bias. At this time, when the alternating voltage is applied to the magnetic brush electrified member 22, by virtue of the oscillation effect based on the electrical field between the photosensitive drum 1 and the injecting sleeve 24, the introduction of the transfer residual toner into the magnetic brush 25 can be easily performed.

The transfer residual toner tentatively recovered by the magnetic brush 25 is effectively restored and electrified from a positive reverse electrified state to a negative electrified state, which is the normal electrified polarity by the negative electrified bias applied to the magnetic brush electrified member 22 and also by the friction with the magnetic brush 25.

The transfer residual toner, which is tentatively recovered by the magnetic brush 25 and effectively restored and electrified to the negative electrified state, which is the normal charged polarity, is delivered from the magnetic brush 25 to the photosensitive drum 1 and adhered there by the electrical repulsive force against the negative electrified bias applied to the magnetic brush electrified member 22.

3) The toner that was delivered from the magnetic brush 25 to the photosensitive drum 1 and restored and electrified to the negative electrified state, which is the normal electrified polarity, passes through a contact region f to be described later between the injecting carrier shielding member 11 and the photosensitive drum 1 by the continuous rotation of the photosensitive drum 1 and reaches the developing region c of the developing apparatus 4 through an image exposing region b of an image exposing apparatus 3 for simultaneous developing and cleaning (simultaneous developing and recovery) by the developing member of the developing apparatus 4.

Here, the delivery of the toner from the magnetic brush of the electrifying device 2 to the photosensitive drum 1 is performed that a small amount of toner is delivered in a uniform distribution, which substantially does not obstruct the image exposure even if the toner passes through the image exposure region b.

Simultaneous developing and cleaning is a method where the photosensitive drum 1 is continuously electrified and latent images are formed there by image exposure and at the time of development from the next steps onward, that is, at the time of developing the latent images, the transfer residual toner remaining on the photosensitive drum 1 after the transfer is recovered by the fog cleaning bias (potential difference Vback, which is the potential difference between the direct current voltage applied to the developing apparatus 4 and the surface potential of the photosensitive drum 1). In the case of reversal developing, this simultaneous developing and cleaning is performed by the electrical field which recovers the toner to the developing member from the dark portion potential of the photosensitive drum and the electrical field action, which adheres the toner to the light portion potential of the photosensitive drum 1. Simultaneous developing and recovery is performed simultaneously with the image forming steps such as other electrification, exposure, developing and transfer when the image area in the rotational direction of the photosensitive drum is longer than the circumferential length of the photosensitive drum 1.

The above described 1) to 3) cleaner-less system will be described a little bit further. The cleaner less system, as described above, recovers the transfer residual toner by simultaneous developing and cleaning in the developing region c by the developing apparatus 4. The transfer residual toner on the photosensitive drum 1 after the transfer generates, in the first place, the above-described ghost if passed as it is through the electrified region a of the electrifying device 2. That is, even when the transfer residual toner passes through under the magnetic brush which contacts the photosensitive drum 1, almost in all cases, the shapes of the previous images are retained and no case was observed where they are uniformly dispersed under the setting of the magnetic brush in suitable electrifying conditions.

Thus, it is necessary that the transfer residual toner which reaches the electrified region a accompanied by the rotation of the photosensitive drum 1 is entrapped by the magnetic brush 25 so that the history of the previous images is eliminated. At this time, applying the direct current voltage to the magnetic brush electrified member 22 alone is not enough to perform the entrapping of the toner toward the magnetic brush 25, but when the alternating voltage is applied to the magnetic brush electrified member 22, the entrapping of the toner toward the magnetic brush 25 can be relatively easily performed by virtue of vibration effect based on the electrical field between the photosensitive drum 1 and the injecting sleeve 24.

However, there are some cases where it is extremely difficult to perform the entrapping of the toner toward the magnetic brush 25 depending on the electrified amount of the transfer residual toner which reaches the electrified region a. That is, so long as the transfer residual toner is electrified, the potential difference between the magnetic brush 25 and the photosensitive drum 1 and a reflection force between the toner and the photosensitive drum have a great effect on the entrapping property.

Here, though it is ideal for the surface potential of the photosensitive drum where the toner passes through to be equally electrified against the applied voltage of the magnetic brush electrified member 22, actually there exists a width also in the electrified region a that is the contact region between the magnetic brush 25 and the photosensitive drum 1. Though this will be eventually electrified to the approximately same potential, because the toner is not sufficiently electrified at the initial stage of passing through the electrified portion, there is produced a potential difference between the magnetic brush and the photosensitive drum. In the case of the present embodiment, because Vdc (dark portion potential) of the magnetic brush electrifying device is set at −700 V, in the area where the photosensitive drum surface potential at the initial stage of passing through the electrified portion is smaller than that, the positive electrified toner is easily entrapped in the direction of the magnetic bush, while the negative electrified toner is not entrapped. Moreover, when the electrified amount of the toner is extremely large and even when the reflection force between the toner and the photosensitive drum is large enough, the toner remains on the photosensitive drum. For this reason, though it is a negative electrified toner by nature, the transfer residual toner is preferably positively electrified. However, even when the toner is not positively electrified, if the absolute value of the electrified amount is small, the effect of scratching it compulsorily by the magnetic brush can be expected.

In fact, the transfer residual toner tends to have the electrified polarity turned in reverse due to the peel discharge and the like at the time of the transfer. Even if the transfer efficiency is the same, the electrified amount distribution varies largely depending on the transfer current. Moreover, long-term use of the toner causes the developer itself to deteriorate and reduces the transfer efficiency, thereby increasing the ratio of the toner negatively electrified to remain on the photosensitive drum as it is. For this reason, it is preferable that the transfer current is strengthened and the means for electrifying the transfer residual toner with a reversal polarity is provided.

In the present embodiment between the transfer region d and the electrified region a, the conductive brush 6 as a supplemental electrifying device is allowed to abut against the photosensitive drum 1 and a bias of the polarity in reverse to the electrified bias is applied. The transfer residual toner positively electrified passes through the conductive brush 6, while the transfer residual toner negatively electrified is tentatively entrapped by the conductive brush 6 and, after being rejected from the electrification, delivered again on the photosensitive drum 1. In this way, the transfer residual toner is more easily entrapped in the direction of the magnetic brush, thereby eliminating the cause of a ghost image.

The conductive brush 6 as the supplemental electrifying device may be a supplemental electrifying device of other types such as a rubber-roller and the like.

The next pending problem is that even when the transfer residual toner is recovered by the magnetic brush 25 of the magnetic brush electrified member 22, if it is kept positively electrified, the transfer residual toner is accumulated inside the magnetic brush 25 without being delivered because of the relation of the potential difference between the magnetic brush and the photosensitive drum as described above. When the toner of more than fixed amount is mixed with the magnetic brush 25, depending on the resistance value and the like of the toner, the electrifying capacity is reduced even in the case where the alternating voltage is superimposed. Moreover, assuming that the toner is delivered to the photosensitive drum by the centrifugal force of a rotating magnetic brush, if the toner is not negatively electrified normally, it is not recovered by the developing apparatus 4 in the non-image region and kept on the photosensitive drum.

Therefore, once the transfer residual toner is entrapped inside the magnetic brush 25 of the magnetic brush electrified member 22, it is turned into a normal positive electrified toner and then a long-term stabilized cleaner process is completed. This can be realized by setting a combination of the frictional electrifying system of the toner and the injecting carrier of the magnetic brush 25 where the toner is offset to a negative polarity. In the present embodiment, against the negative toner using polyester for a binder resin, the toner where the surface of magnetite single substance such as ferrite and the like is coated by resin and adjusted in resistance was used.

In such an image forming apparatus, when the injecting carrier was replaced by the pulverized carrier in order to enhance the electrostatic property for the photosensitive drum 1, if passing-sheet endurance was maintained, the photosensitive drum 1 became defective before the number of passing-sheets reached 20 thousand. This caused defects such as a streak, fog, and the like on the images. As a result of concentrated studies, it was discovered that the injecting carrier adhered with the carrier from the electrifying device 2 reaches to the transfer region d and enters between the contact transfer member such as the photosensitive drum and the transfer belt and the transfer blade and the transfer roller and by the pressure of the transfer member, the injecting carrier is embedded in the photosensitive drum surface and the photosensitive drum becomes defective by the friction.

Hence, in the present embodiment, as shown in FIG. 1, FIG. 3, in the position at the downstream side of the rotational direction of the photosensitive drum rather than the electrified region a and at the upstream side of the rotational direction of the photosensitive drum rather than the exposure region b, an elastic silicon sheet having a thickness of 300 $\mu$m as the injecting carrier shielding member 11 is disposed so as to abut against the rotation of the photosensitive drum by light pressure and counter to its rotation.

The pressure of the above described sheet 11 against the photosensitive drum 1 is preferably 0.3 kPa to 3.0 kPa. If it is equal to or less than that, the injecting carrier attached with the carrier on the photosensitive drum 1 surface slips off the contact region f between the sheet 11 and the photosensitive drum 1, while if it is equal to or more than 3.0 kPa, the majority of the toner delivered from inside the magnetic brush 25 of the electrifying device 2 is barred at the contact region f between the sheet 11 and the photosensitive drum 1.

In order to set a pressure within the above described pressure range this time, the free length of the sheet 11 was set at 6 mm, the penetration amount was set at 1 mm, the abutting angle was set at 30 degrees from the tangential direction of the photosensitive drum and the actual pressure was set at 2.0 kPa. Moreover, the sheet 11 was set in an attractive force range by the magnetic field of the injecting sleeve 22, that is, disposed so as to contact the photosensitive drum 1 at the position adjacent to the electrified region a, which is the contact region between the magnetic brush 25 of the electrifying device 2 and the photosensitive drum 1.

At the contact region f between this sheet 11 and the photosensitive drum 1, the injecting carrier attached with the carrier on the photosensitive drum 1 from the magnetic brush 25 of the electrifying device 2 was barred and delivered again inside the electrifying device 2 by the magnetic force of the injecting sleeve 24.

Moreover, the transfer residual toner delivered on the photosensitive drum 1 surface from the magnetic brush 25 of the electrifying device 2 easily slips off the contact region f between the sheet 11 and the photosensitive drum 1 and is carried to the developing region c for simultaneous developing and cleaning by the developing apparatus 4. In the present embodiment, approximately 90% of the whole toner delivered from the magnetic brush 25 slips off the contact region f between the sheet 11 and the photosensitive drum 1 so as to be carried to the developing region c and approximately 10% thereof is barred.

In such a configuration, as a result of the passing-sheet endurance conducted by an original having an image visualization ratio of 6%, no faulty image such as streak, fog, and the like attributable to the photosensitive drum defect, was observed up to fifty thousands sheets, and fine and stabilized images were kept. Moreover, the toner is suitably delivered from the electrifying device and faulty electrification attributable to the toner contamination of the electrifying device can be prevented.

The injecting carrier shielding member may be an elastic blade member, an elastic brush shaped member, and the like in place of the elastic sheet 11.

Next, another embodiment will be described.

In the present embodiment, the toner having an average particle size of 6 $\mu$m (hereinafter referred to as superimposed toner) manufactured by a superimposing method as a toner t of the two component developer 46 of the developing apparatus 4 in the image forming apparatus of the above described embodiment was used.

The superimposed toner is a toner having extremely excellent separability and is effective for improving a cleaning efficiency in simultaneous developing and cleaning.

In the present embodiment, because superimposed toner having a good fluidity was used as it is closer to a spherical shape than the pulverized toner as a toner t, the transfer toner delivered from the magnetic brush 25 of the electrifying device 2 to the photosensitive drum 1 surface more easily slips off the contact nip region f between the sheet 11 and the photosensitive drum 1 and is carried to the developing region c for simultaneous developing and cleaning by the developing apparatus 4.

To be more concrete, in the case of the embodiment 1 where the pulverized toner is used, the ratio of the transfer residual toner delivered from the magnetic brush 25 of the electrifying device 2 to the photosensitive drum 1 surface being barred at the contact nip region f between the sheet 11 and the photosensitive drum 1 is approximately 10% of the whole toner, while in the case of the present embodiment using the superimposed toner, the ratio of the transfer residual toner delivered from the magnetic brush 25 of the electrifying device 2 to the photosensitive drum 1 surface being barred at the contact region f between the sheet 11 and the photosensitive drum 1 is approximately 3%, and almost all the delivered toner slips off the contact nip region f between the sheet 11 and the photosensitive drum 1 and is recovered by the developing apparatus 4.

Accordingly, in the case of the present embodiment, the amount of the toner remaining inside the electrifying device 2 is extremely reduced and, in the passing-sheet endurance with an image visualization ratio of 6%, excellent images were maintained up to seventy thousands sheets.

Next, an embodiment for preventing the toner flying from the electrifying device will be described.

Figure 7:
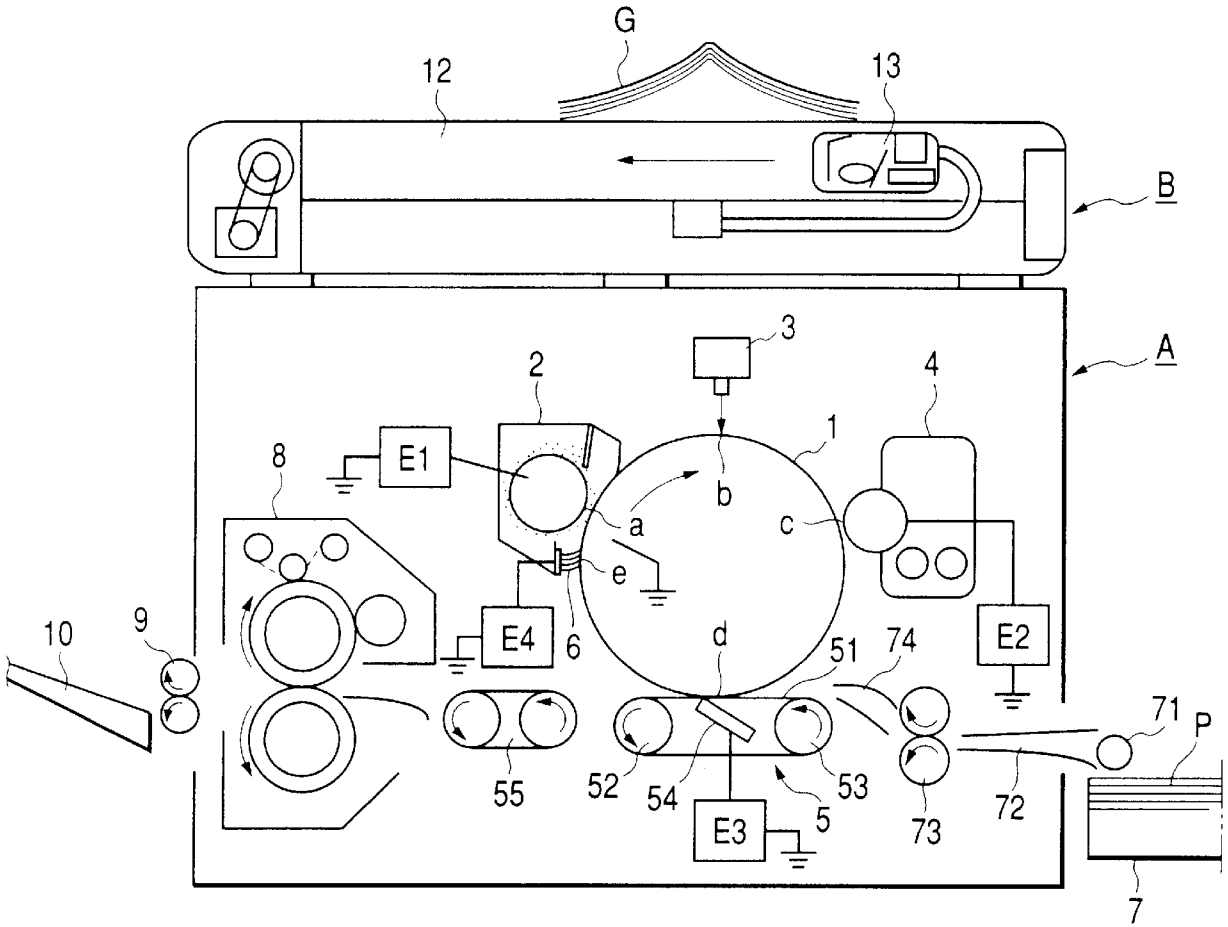
FIG. 7 is a view showing an image forming apparatus according to another embodiment of the present invention.

FIG. 7 is a schematic drawing of the image forming apparatus of the embodiment of the present invention. The same components as those of the above described embodiment are attached with the same reference numerals and therefore the description thereof are omitted and those portions different from the above will be described.

In the present embodiment, the transfer material P which passed the transfer region d and received the transfer of the toner images are separated in order from the surface of the photosensitive drum 1, are then carried to the fixing device 8 by a carrying belt device 55 and, by receiving thermal fixation of the toner images, are outputted as an image formed object (copy, print) on a sheet discharging tray 10 outside of a sheet discharging roller 9.

Figure 8:
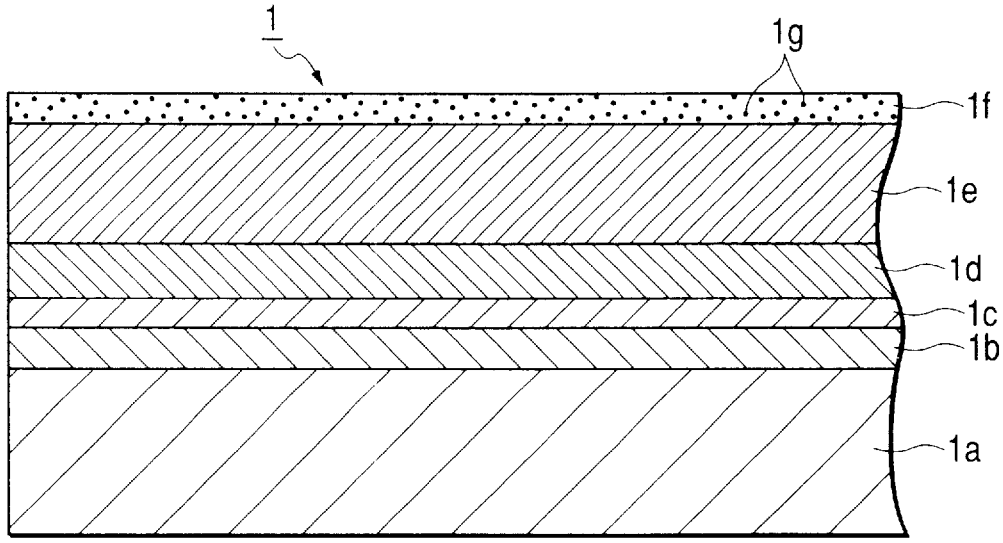
FIG. 8 is a view showing a configuration of the layer of a photosensitive drum.
Figure 9:
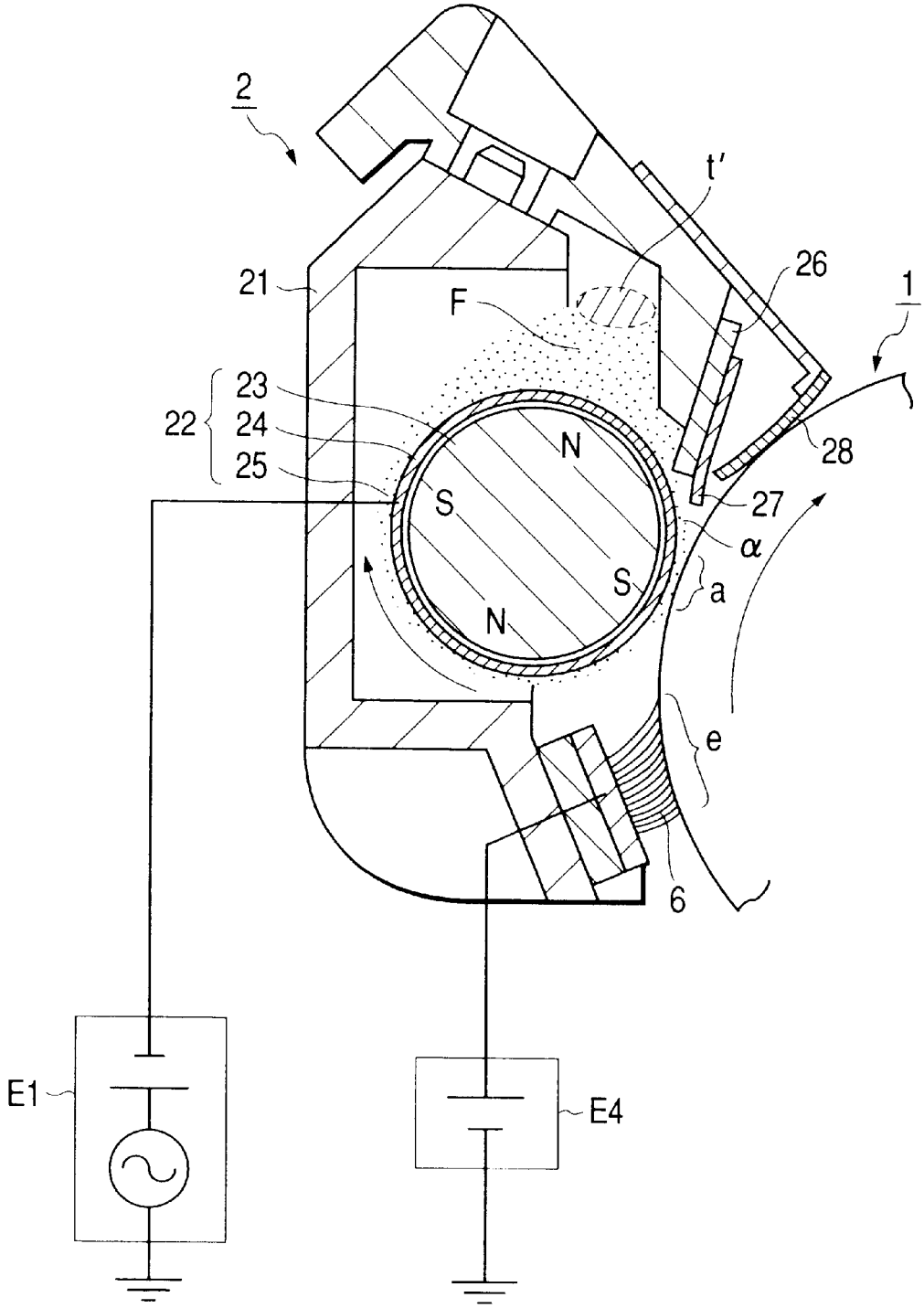
FIG. 9 is a view showing an electrifying apparatus and a periphery thereof.
Figure 10:
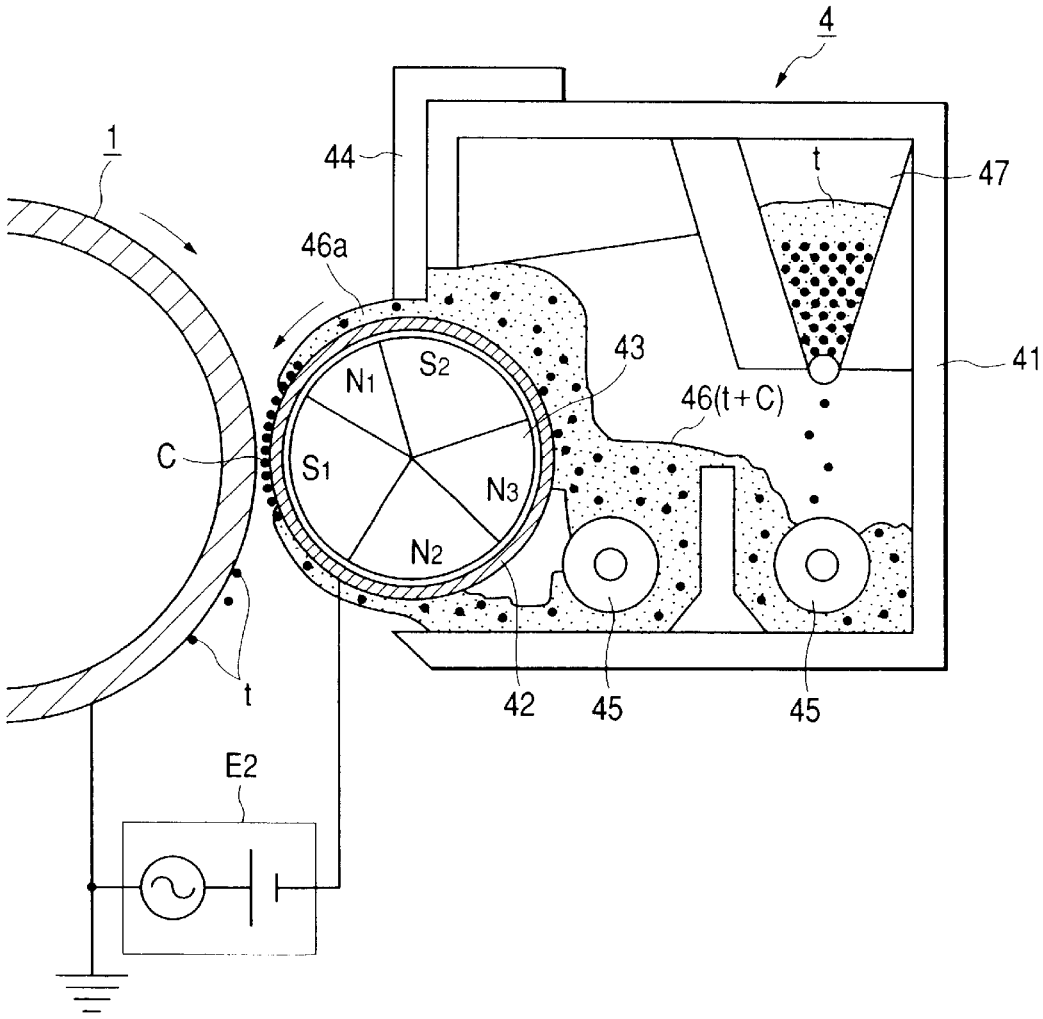
FIG. 10 is a view showing a developing apparatus.
Figure 11:
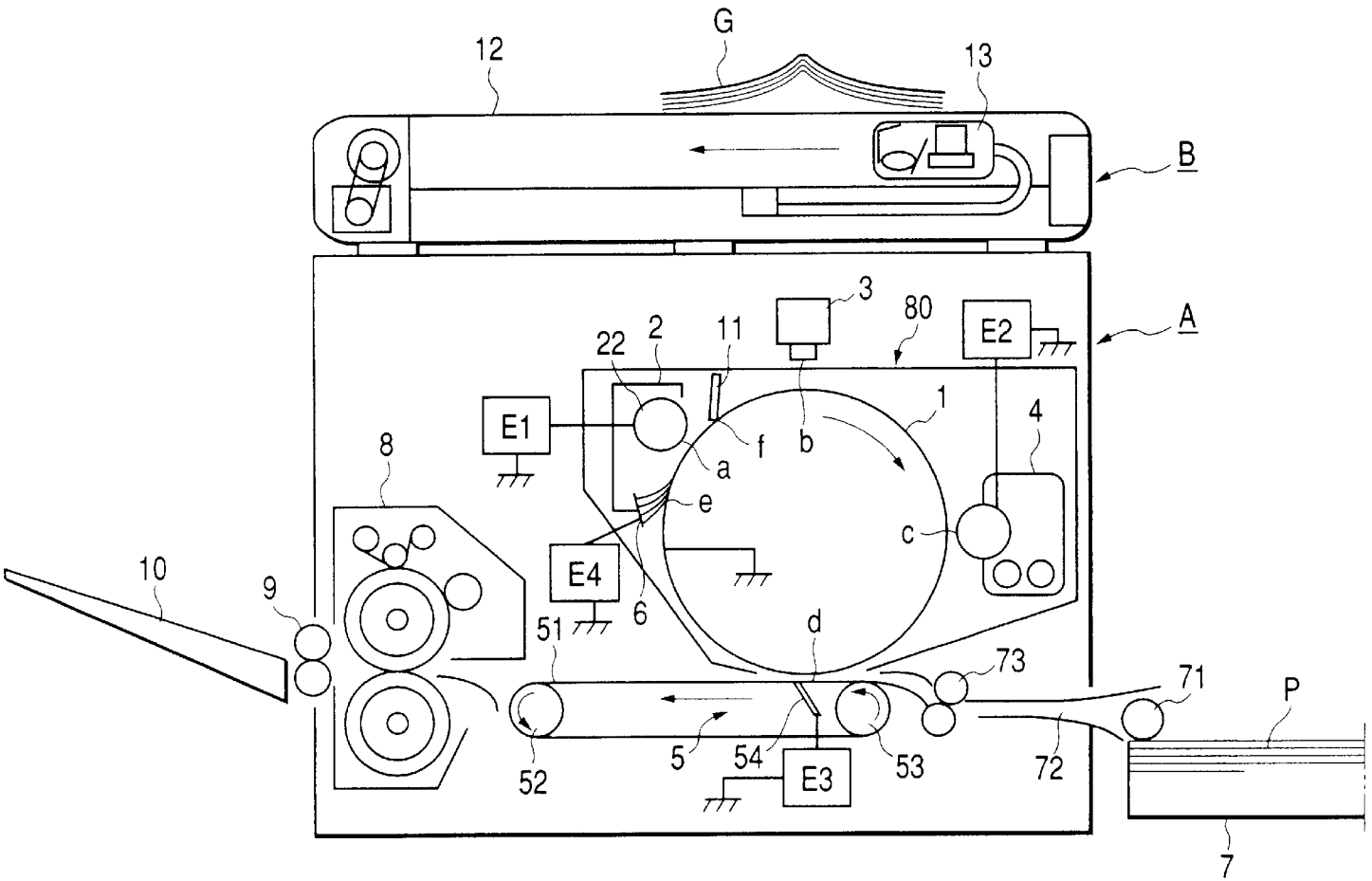
FIG. 11 is a view showing an image forming according to still another embodiment of the present invention.

FIG. 8 shows a layer configuration of the sensitive member, FIG. 9 is a drawing to show an electrifying device and FIG. 10 is a drawing to show a developing apparatus. The same components as those of the above described embodiment are attached with the same reference numerals and therefore the description thereof are omitted and those portions different from the above will be described.

In FIG. 10, in the present embodiment, an excellent electrostatic property was obtained by applying a bias superimposed with a rectangular alternating voltage of 1000 Hz, 800V to the electrifying device against the direct current of −700V.

In FIG. 9, reference numerals 27, 28 are first and a second shielding members disposed inside and provided for the electrifying device 2 as image forming apparatus inside contamination prevention means, which will be described in detail in the later clause.

In the present embodiment, between the transfer region d and the electrified region a, a conductive brush 6 of fur blush made of rayon as the supplemental electrifying device is abutted against the photosensitive drum 1 and an electrified bias and a bias of +500V of a reverse polarity were applied. A transfer residual toner of the positive polarity passes the conductive brush 6, and the transfer residual toner of the negative polarity is tentatively entrapped by the conductive brush 6 and, after being rejected from the electrification, delivered on the photosensitive drum 1 again. At this time, when the toner is accumulated on the fur brush surface without the bias and the like applied for actively delivering it on the photosensitive drum, the sustained amount reaches its limit and the toner rejected from electrification is returned in order on the photosensitive drum. Accordingly, the toner invading the electrified region a, which is the contact region between the magnetic brush electrified member 22 and the photosensitive drum 1, is limited to the toner of the electrified polarity and the reversal polarity, or the toner rejected from electrification and low in the electrified amount and recovered for the most part inside the magnetic brush 25 of the magnetic brush electrified member 22. At this time, the history of the previous images is removed and the direct cause of generating the ghost is eliminated.

(7) Image Forming Apparatus Internal Contamination Prevention Means

In the area $\alpha$ where the magnetic brush 25 of the magnetic carrier carried with the rotation of the sleeve 24 borne on the outer peripheral surface of the non-magnetic sleeve 24 passes the position of the layer thickness control blade 26 (hereinafter described as control portion) and reaches the contacting point a (FIG. 3) to the photosensitive drum 1, there exists the toner which flies separated from the magnetic carrier of the direct magnetic brush 25. When the passing-sheet of the original having the image visualization of 6% exceeds ten thousands sheets, the exposure surface of the LED image exposure device 3, which is image exposure means disposed between the electrifying device 2 and the developing apparatus 4, is contaminated and the image area, which should be primarily exposed, is shielded from exposure. Thus, the problem of the images coming off white sometimes occurs.

As a result of concentrated studies, it was discovered that the majority of the flying toner t', which was isolated and accumulated in an agent convention region F (the magnetic carrier convention portion) of the back side of the control member 26, reaches in FIG. 3 the control portion (bottom edge portion) of the control member 26 along the back of the control member 26, while being kept isolated from it and, after passing through the control region, flies from the vicinity of the discharge port of the control member 26.

Hence, in the present embodiment, as shown in FIG. 9, as the prevention means of the image forming apparatus inner contamination, a sheet shaped member 27 as a first flying toner shielding member was disposed so as to allow the tip portion to approach closely or contact lightly the magnetic carrier of the magnetic brush 25 in the downstream side of the rotational direction of the non-magnetic sleeve in the closest position between the above control member 26 and the non-magnetic sleeve 24 and in the upstream side of the rotational direction of the non-magnetic sleeve rather than the electrified region a.

To be concrete, a urethane sheet 27 having a direct thickness of 200 $\mu$m was disposed on the control member 26 in such a manner that its tip portion lightly contacts the magnetic carrier of the magnetic brush 25 controlled in the layer thickness by the control member 26. By this sheet 27, the control member 26, and the magnetic brush 25 of the magnetic carrier on the nonmagnetic sleeve 24, a substantially airtight space is formed and the majority of the toner flying from the vicinity of the discharge port of the control member 26 is shielded and reaches the electrified region a accompanied by the carrying of the magnetic brush 25 of the magnetic carrier. The one toner portion thereof is carried to the developing region c attached on the photosensitive drum 1, while the one toner portion is mixed with the magnetic brush 25 of the magnetic carrier and recovered again to the electrifying device 2, thereby reducing the flying toner to a large extent.

Moreover, in the present embodiment, as the prevention means of the image forming apparatus inside contamination, a sheet shaped member 28 (abutting member) as a second flying toner shielding member was disposed so as to contact the photosensitive drum 1 in a position downstream of the rotational direction of the photosensitive drum rather than the electrified region a and at the upstream rather than the exposure region b. This abutting member 28 is attached to the housing 21 which stores the electrifying member 22.

This abutting member 28 is an elastic sheet shaped member, and to be concrete, the urethane sheet 28 is used, which was abutted against the sensitive member 1 counter to the rotational direction of the photosensitive drum. The free length of this urethane sheet 28 was taken as 6 mm and the approach amount as 2 mm. By this sheet 28, the toner that was still flying from the area range from the tip portion of the urethane sheet 27 as the above-described first flying toner shielding member to the electrified region a can be prevented.

In such a configuration, as a result of the passing-sheet endurance conducted by the original having the image visualization of 6%, the exposure surface of the LED image exposure device 3 was not contaminated up to fifty thousands sheets and excellent stabilized images were maintained.

Next, another embodiment will be described.

The present embodiment uses a urethane rubber sheet having a thickness of 1 mm with its surface coated by nylon in place of the urethane sheet as the sheet shaped member 28, as the second flying toner shielding member in the image forming apparatus of the above-described embodiment. The surface coated with nylon is abutted against the photosensitive drum 1 and its free length is taken as 6 mm and its approach amount is taken as 1 mm.

The image forming apparatus configuration other than the above described is the same as the image forming apparatus of the above described embodiments.

In the above-described embodiment, there was the case where in the later course of the passing-sheet endurance, the toner ratio inside the electrifying device 2 was increased and the toner delivered to the photosensitive drum 1 with the magnetic carrier covered by the toner was unable to sufficiently obtain the normal negative charge and therefore it turned around the photosensitive drum 1 accompanied by it without being recovered by the developing apparatus 4. There was the case where, when the passing-sheet endurance exceeded fifty thousands sheets, the accompanied toner on the photosensitive drum reached 10% in reflectance and obstructed the exposure and the image density was reduced. Again, there was the case where when the passing-sheet endurance exceeded fifty thousands sheets, a part of the exposure surface of the LED image exposure device 3 began to be contaminated by the flying toner, and a partial image missing occurred.

In the present embodiment, for the sheet shaped portion 28 as the second flying toner shielding member, the urethane sheet 28 coated with nylon, which is the electrifying system for giving the toner the normal negative charge polarity, is used. Hence, the toner delivered from the electrifying device 2 contacts the surface layer of the sheet shaped member 28 as the second flying toner shielding member on the photosensitive drum 1 and is electrified with a normal negative polarity so that, from among the toner which reaches the developing portion c, the toner on the non-image area in the subsequent image is recovered by the developing bias, while the toner on the image area remains on the photosensitive drum 1 and, together with the usual developed toner, is transferred on the transfer material P.

Accordingly, the toner, which turned around the photosensitive drum 1 accompanied by it, was extremely reduced and excellent images were maintained up to seventy thousands sheets in the passing-sheet endurance of the image visualization of 6%.

Next, still another embodiment will be described.

The present embodiment used a conductive polyurethane sheet dispersed with carbon black as the sheet shaped member 28 as the second flying toner shielding member in place of a nylon sheet in the image forming apparatus of the above-described embodiment and this was abutted against the photosensitive drum 1 in a floating state.

The image forming apparatus other than the above described is the same as the image forming apparatus of the above described embodiment.

The present embodiment can obtain the effect of preventing the above-described toner flying and producing more electrification potential uniformity. That is, there was the case where the potential history of the previous image is not completely eliminated. Particularly, the portion of the high density image has a large amount of transfer residual toner by that much, which when recovered by the electrifying device, is considered to obstruct the electrification performed at the same time. Moreover, in contrast to the non image area not exposed by the previous image, the electrification has to be performed from a much lower potential and there was the case where when the electrified member 22 and the supplemental electrified member 6 deteriorated due to the passing-sheet endurance, uniformity was difficult to maintain even after the electrification, and a potential difference of more or less 5 to 20V occurred.

However, like the present embodiment, by abutting the conductive member as the toner flying prevention member 28 against the photosensitive drum, non-uniformity of the potential was cancelled and the positive ghost was eliminated.

As described in the above embodiments, in the image forming apparatuses of the transfer system, the cleaner-less system uses the contact electrifying device 2, the the flying prevention sheets 27, 28 are disposed between the contact electrostatic electrified member 22 of the electrifying device 2 and the contact region a to exposure region b of the photosensitive drum 1, a member is employed which is the electrification system for particularly giving the normal charge to the toner and moreover, when the magnetic brush injecting electrifying device is particularly used, the disposing of the sheets on the control member discharge port can prevent the toner from flying inside the apparatus and maintain excellent exposure conditions without leaving the accompanied toner on the photosensitive drum.

Note that, in the above-described embodiment according to FIG. 9 also, by setting the pressure of the abutting member 28 against the photosensitive drum 1 at 0.3 kPa to 3 kPa, the magnetic carrier can be suitably prevented at the position of the abutting member 28 and the toner can be suitably allowed to pass through.

Note that the present invention can be also adapted to the image forming apparatus where the process cartridge 80 housing at least the photosensitive drum 1, the electrifying apparatus 2, and developing apparatus 4 is detachably attachable to the main body of the apparatus.

Moreover, the contact electrified member of the contact electrifying means is not limited to the magnetic brush electrified member of the conductive magnetic particles, but may be the conductive roller, the fur brush contact electrified member, and the like using conductive rubber and conductive sponge. A contact electrified member that is fixed not to be rotated may be used.

Moreover, the image bearing member can realize a charge injecting electrification by having a low resistance layer with a surface resistance of $10^9$ to $10^{14}$ Ω·cm, which is preferable in view of preventing ozone from being generated and the like, but may be an organic sensitive member and the like other than that described above. That is, the contact electrification may be provided not only by the charge injecting electrification method of the embodiments, but also in a contact electrification system that utilizes an electrical discharge.

Moreover, for the voltage waveform in the case where the alternating voltage (AC voltage) is included in the bias against the electrifying means and developing means, a sine wave, a rectangular wave, a chopping wave, and the like, are suitably used. It may be the rectangular wave formed by periodically switching on and off the direct current power source. In this way, for the waveform of the alternating voltage, the bias where the voltage waveform periodically changes can be used.

Moreover, for the exposure means for forming the writing of the latent images, it is not limited to the LED array writer head, such as used in the embodiments, but the means capable of performing the image exposure corresponding to the image information, such as laser scanning exposure means, analogous image exposure means and the like, can be used.

Moreover, the image bearing member may be electrostatic recording dielectric. In this case, the dielectric is uniformly primarily electrified with predetermined polarity and potential and, after that, rejected selectively from the electrification by an electrification rejecting means, such as an electrification rejecting needle head, an electronic gun and the like and the electrostatic latent images of the image information are written and formed.

Moreover, in the embodiments, though the developing apparatus is the two component developing apparatus, it may be the apparatus of another developing system. Preferably, the contact developing system where the developer is allowed to contact the image bearing member and develop the latent images is advantageous for simultaneously producing developing and cleaning efficiency.

Moreover, the transfer means can be of the transfer roller type and the like other than the belt transfer apparatus. It may be of a system where the toner images formed and borne on the image bearing member are transferred to a medium transfer member.

Moreover, the first and/or the second flying toner shielding members 27, 28 as the image forming apparatus inner contamination prevention means for shielding the developer (toner) flying from the contact electrified member are not limited to the insulating and conductive sheet shaped member, but can be the insulating and conductive brush shaped member or the member having another shape.

Having described the embodiments of the present invention as above, it is to be understood that the present invention is not restricted by any embodiment as described above and every modification is possible within the technical idea of the present invention.

What is claimed is:

1. An image forming apparatus comprising:

an image bearing member for bearing an image, wherein said image bearing member is movable;

electrifying means having an electrification particle for slidably rubbing said image bearing member and electrifying said image bearing member, said electrifying means recovering residual toner on said image bearing member and returning the residual toner to said image bearing member;

image exposure means for image-exposing said image bearing member electrified by said electrifying means and forming a latent image;

developing means for developing the latent image with toner and recovering the residual toner on said image bearing member; and particle barring member for barring the electrification particle while substantially passing the toner, said barring member being arranged downstream of an electrifying portion of said electrifying means and upstream of a developing portion of said developing means in a moving direction of said image bearing member.

2. An image forming apparatus according to claim 1, wherein said particle barring member abuts against said image bearing member at a abutting pressure 0.3–3 kPa.

3. An image forming apparatus according to claim 1, wherein said particle barring member has elasticity and is in the form of a sheet.

4. An image forming apparatus according to claim 1, wherein said particle barring member is arranged upstream of an exposing position in the moving direction of said image bearing member.

5. An image forming apparatus according to claim 1, wherein the electrification particle has a magnetic material.

6. An image forming apparatus according to claim 5, wherein the electrification particle is formed by grinding.

7. An image forming apparatus according to claim 1, wherein said toner is formed by polymerizing.

8. An image forming apparatus according to claim 1, wherein the electrification particle electrifies said toner to the same polarity as an electrification polarity of said electrifying means by triboelectrification.

9. An image forming apparatus according to claim 1, wherein a surface contacting with said toner of said particle barring means electrifies said toner to the same polarity as the electrification polarity of said electrifying means by triboelectrification.

10. An image forming apparatus according to claim 1, wherein said particle barring means has electric insulation.

11. An image forming apparatus according to claim 1, wherein said particle barring means is conductive.

* * * * *

UNITED STATES PATENT AND TRADEMARK OFFICE

CERTIFICATE OF CORRECTION

PATENT NO. : 6,505,021 B2
DATED : January 7, 2003
INVENTOR(S) : Kenichi Shibuya et al.

It is certified that error appears in the above-identified patent and that said Letters Patent is hereby corrected as shown below:

Title page, Item [54] and Column 1, line 3,
Title, "FORM" should read -- FROM --.

Column 1,
Lines 29 and 43, "cleaner-less" should read -- cleanerless --.

Column 3,
Line 7, "exist" should read -- exists --.
Line 8, "differences" should read -- difference --.
Line 40, "to" should read -- to as --.

Column 4,
Line 1, "cleaner-less" should read -- cleanerless --.

Column 8,
Line 24, "above described" should read -- above-described --; and "cleaner-less" should read -- cleanerless --.
Line 45, "an" should read -- a --.

Column 10,
Line 46, "two" should read -- two-compo- --.

Column 11,
Line 3, "an" should read -- a --.

Column 14,
Line 19, "above described" should read -- above-described --.

Column 16,
Lines 34 and 44, "above described" should read -- above-described --.

Column 17,
Line 23, "above" should read -- above- --.
Line 62, "above described" should read -- above-described --.

UNITED STATES PATENT AND TRADEMARK OFFICE

CERTIFICATE OF CORRECTION

PATENT NO. : 6,505,021 B2
DATED : January 7, 2003
INVENTOR(S) : Kenichi Shibuya et al.

It is certified that error appears in the above-identified patent and that said Letters Patent is hereby corrected as shown below:

Column 18,
Line 10, “above described” should read -- above-described --.

Column 20,
Lines 7 and 8, “above described” should read -- above-described --.
Line 53, “above” should read -- above- --.
Line 64, “non” should read -- non- --.

Column 22,
Line 58, “a” should read -- an --.

Signed and Sealed this

Eleventh Day of November, 2003

JAMES E. ROGAN
*Director of the United States Patent and Trademark Office*